US011523234B2

(12) United States Patent
Yu et al.

(10) Patent No.: US 11,523,234 B2
(45) Date of Patent: Dec. 6, 2022

(54) MINIATURE EAR CANAL TYPE HEARING AID

(71) Applicant: XIAMEN NEWSOUND TECHNOLOGY CO., LTD., Fujian (CN)

(72) Inventors: Shihu Yu, Fujian (CN); Boyang Li, Fujian (CN); Chengyu Li, Fujian (CN)

(73) Assignee: XIAMEN NEWSOUND TECHNOLOGY CO., LTD., Fujian (CN)

( * ) Notice: Subject to any disclaimer, the term of this patent is extended or adjusted under 35 U.S.C. 154(b) by 0 days.

(21) Appl. No.: 17/218,853

(22) Filed: Mar. 31, 2021

(65) Prior Publication Data

US 2021/0314713 A1 Oct. 7, 2021

(30) Foreign Application Priority Data

Apr. 1, 2020 (CN) ..... 202010248376.X

(51) Int. Cl.
*H04R 25/00* (2006.01)
*H04R 25/02* (2006.01)

(52) U.S. Cl.
CPC ..... *H04R 25/65* (2013.01); *H04R 25/02* (2013.01); *H04R 25/60* (2013.01); *H04R 2460/17* (2013.01)

(58) Field of Classification Search
CPC ..... H04R 25/65; H04R 25/02; H04R 25/60; H04R 2460/17
See application file for complete search history.

(56) References Cited

U.S. PATENT DOCUMENTS 6,724,902 B1 * 4/2004 Shennib ..... H04R 25/656 607/57
2001/0043708 A1 * 11/2001 Brimhall ..... H04R 25/656 381/328

* cited by examiner

*Primary Examiner* — Sunita Joshi
(74) *Attorney, Agent, or Firm* — Muncy, Geissler, Olds & Lowe, P.C.

(57) ABSTRACT

The present invention discloses a miniature ear canal hearing aid, electronic elements other than a receiver being wrapped inside a housing, a front end of the housing being sealed and fixed at a rear end of the receiver, a sound outlet of the receiver being exposed to an outside of the housing, the receiver being wrapped with an eardrum head thereon, the eardrum head being fixed at the front end of the housing in a detachable manner, and the sound outlet of the receiver being located inside the eardrum head. The structure of the present invention can increase a degree of curvature of a portion going deep into the ear canal, reduce a volume of the hearing aid, and improve adaptability, comfort and concealment.

10 Claims, 10 Drawing Sheets

MINIATURE EAR CANAL TYPE HEARING AID

TECHNICAL FIELD

The present invention relates to the technical field of the hearing aid and earphones, and in particular, to a miniature ear canal hearing aid.

BACKGROUND

Hearing aid is a tool, apparatus, device, instrument and the like that help people with hearing disabilities to improve their hearing impairment and thereby to further improve their ability to communicate with other people, which transmit weaker sound to patient's ear canal after amplifying it so that the patient can hear the weaker sound. The hearing aid includes a behind-the-ear (BTE) hearing aid, an in-canal hearing aid, a pocket hearing aid and the like according to different outer appearances.

A volume of a hearing aid is one of major factors that restricts the desire of terminal users to wear the hearing aids. At present, the volume of the most ear canal hearing aids is still too large, which affects wearing comfort and concealment of the terminal users. Meanwhile, the occasional high-pitched howling will easily reduce customer experience and increase manufacturers' repair costs.

For traditional standard in-canal hearing aids, their housings are hard plastic parts, which are manufactured by a plastic molding or film coating process. Electronic elements such as a battery, a chip, a receiver and a microphone etc. are disposed inside a cavity of the housing, and are protected from damage with the help of the hard plastic housings. In order to increase wearing comfort and improve the sealability to prevent the hearing aid from generating howling feedback, and an in-ear portion of the in-ear hearing aid is generally wrapped in an eardrum head soft rubber.

However, after carefully analyzing this kind of hearing aid, manufacturers discover that following problems exist.

First, a human ear canal has a curvature similar to a turn, i.e., a turning point, thus, if a form of the hearing aid is relatively straight, it can encounter this turning point while being worn in the ear canal and easily cause tingle, and cannot be worn deeper. Generally, the in-canal hearing aid will bend a certain angle to fit a curve radian of the ear canal such that the hearing aid can be worn deeper. However, as for traditional in-canal hearing aids, since a receiver is completely wrapped in a front end of a hard plastic housing and a bending point of the housing is disposed near to a mounting position of the receiver such that both ends of a bending portion of the housing are longer, this restricts a bending angle of the hearing aid. If the angle is too large, a mold of the hard plastic housing cannot process. Therefore, the existing in-canal hearing aid may have small bending angles, cannot go deeper into the ear canals, are not suitable for actual ear canal shapes of most people, and have poorer wearing comfort and concealment, or some merchants divide a hard plastic housing into two halves along a center line to be respectively molded, then adhere the divided hard plastic housings together by a means of glue to achieve a purpose that the front end (an in-ear portion) of the hard plastic part bends a larger angle. However, in view of the overall small size of the hearing aid product, this glue adhesion can be completed with a help of mechanical apparatus, but can only be performed manually. The labor cost is high, the production efficiency is low, the product quality is unstable, and at the same time, risks of glue failure and allergies caused by glue pollution and the glue irritating the skin further exist.

Second, as for the traditional in-canal hearing aid, the receiver is completely wrapped in the front end of the hard plastic housing, then is wrapped with a soft rubber eardrum head at the outside. By means of the soft rubber eardrum head, although the wearing comfort can be enhanced, and an anti-howling feedback function generated by solid conduction of sound waves through the hard plastic housing can be appropriately reduced (sound leakage of elements, mutual interference of the receiver and the microphone is still unresolved), the volume of the front end of the hearing aid is increased in a disguised way, so that the hearing aid cannot easily go deep into the canal, thereby reducing the number of people to whom it adapts and causing poor concealment.

Third, the receiver and the microphone of the traditional in-canal hearing aid are wrapped together inside one hard plastic housing, situations of sound leakage of the elements, mutual interference of the receiver and the microphone and howling feedback caused by solid conduction of the sound waves through the hard plastic housing are existing, and high-pitched sound occurs, thereby increasing repair and maintenance costs of the manufacturers while reducing the user experience.

At last, since the receiver is wrapped in the hard plastic housing, some cerumen or oily residuals in the ear canal will enter a sound outlet position of the receiver through small holes of a cerumen net after the long-term wearing of the terminal user, and may be accumulated more and more with the long-term wearing to thereby block the sound outlet of the receiver, so that the user cannot use the hearing aid normally, and it is not hygienic either. In addition, the hard plastic housing is fixed by processes of adhering with glue and the like, the user cannot clean it by himself/herself and must hand it over to a professional to remove the housing for cleaning, resulting in huge labor costs and a long waiting period.

In consideration of these, inventors of the present invention improve the structure of the traditional in-canal hearing aid, and develop and design a new type of ear canal hearing aid.

SUMMARY

In order to resolve the above problems, the purpose of the present invention is to provide a miniature ear canal hearing aid to increase a degree of bending of a portion going deep into the ear canal, reduce a volume of the hearing aid, and improve adaptability, comfort and concealment.

In order to achieve the above purpose, a solution of the present invention is:

a miniature ear canal hearing aid, electronic elements other than a receiver being wrapped inside a housing, a front end of the housing being sealed and fixed at a rear end of the receiver, a sound outlet of the receiver being exposed to an outside of the housing, the receiver being wrapped with an eardrum head thereon, the eardrum head being fixed at the front end of the housing in a detachable manner, and the sound outlet of the receiver being located inside the eardrum head.

The electronic elements other than the receiver are a chip, a microphone and a battery box, a battery in the battery box supplies power to the receiver, the chip and the microphone, external sound is received by the microphone, processed by the chip, then transmitted to the receiver and played by the receiver, a position of the housing corresponding to the microphone is provided with a sound pick-up hole, a position of the housing corresponding to the battery box is provided with a charging hole, a switch key is mounted on the housing to be connected with the chip and the battery, and the rear end of the housing is mounted with a pulling wire.

The housing is divided into two portions of an upper housing and a lower housing, the upper housing is divided into a left half housing and a right half housing, a bottom of the right half housing and a top of the lower housing are sealed and joined together, the battery box is mounted in the left half housing, and the right half housing and the left half housing are sealed and joined together in a detachable manner, so as to facilitate replacement of the battery box and maintenance for the inside of the hearing aid etc. Vertical limit fitting groove and clamping strip and left-right limit fitting hook and buckle are formed between the left half housing and the right half housing, and the left half housing and the right half housing are joined together with the help of the vertical limit fitting of the groove and the clamping strip, and the left-right limit fitting of the hook and the buckle.

The front end of the housing forms a mounting opening, and a rear end of the housing is fixed in the mounting opening through fasten fitting. A sealant is further disposed between the rear end of the receiver and the mounting opening of the housing. Barbs are further formed on an inner wall of the mounting opening of the housing, and the rear end of the receiver is tightly fixed in the mounting opening by squeezing the barbs.

The hearing aid is designed to be in a bending form corresponding to a curvature of a turn of a human ear canal, the fixing positions of the front end of the housing and the rear end of the receiver are located at the bending portion of the hearing aid.

The front end of the housing forms a flange and a groove, the eardrum head expands outwardly corresponding to the flange, is provided with a snap ring corresponding to the groove, and is fixed at the front end of the housing with the help of the snap ring being clamped in the groove. The snap ring and a main body of the eardrum head are separately manufactured and then combined together, or the snap ring and the main body of the eardrum head are molded using a soft rubber.

Fins inclined outwardly from the front to the back are formed around the eardrum head.

The eardrum head is opened and provided with sound outlet holes, and a filter net is mounted on the sound outlet holes.

After adopting the above solution, in comparison with the structure of the traditional in-canal hearing aid, the present invention has following advantages.

First, according to the present invention, the front end of the housing is sealed and fixed at the rear end of the receiver, so that most portion of the receiver is exposed to the outside of the housing, only the chip, the microphone and other electronic elements are still protected inside the hard plastic housing, a portion of the housing for fixing the receiver is greatly shortened (the front end of the housing going deep into the ear canal along with the receiver is dramatically shortened), the housing mold easily processes, and the mold can easily realize a requirement for large-angle bending at a portion for fixing the receiver to thereby implement the large-angle bending of the hearing aid, so as to make the hearing aid conform more to the structure of the human ear canal, which can improve a proportion of the people to whom it adapts and the wearing comfort. Meanwhile, the adhering using a means of glue is avoided, the labor costs are reduced, the production efficiency is enhanced, the product quality is stable, and allergies caused by glue pollution and the glue irritating the skin are avoided.

Second, according to the present invention, most portion of the receiver is exposed to the outside of the housing, the soft rubber eardrum head is directly used to wrap the receiver for protection, an area covered by the hard plastic housing is greatly reduced such that the volume of the portion going deep into the ear (the volume of the front end of the hearing aid) is significantly reduced, the hearing aid can go deep into the ear canal more easily, and this improves the proportion of the people to whom it adapts, enhances the wearing comfort and has good concealment.

Third, according to the present invention, the electronic elements other than the receiver are wrapped inside the housing, while most portion of the receiver are exposed to the outside of the housing, so that the microphone and the receiver are respectively disposed at the inside and the outside of the housing; moreover, the sound outlet of the receiver is exposed to the outside of the housing and located inside the eardrum head, and the connection sealability of the receiver and the housing is stronger than that of the traditional in-canal hearing aid, this reduces the risks of the sound leakage and the solid conduction inside the housing to thereby reduce a probability of generating the feedback howling greatly, and enhances the production yield and the wearing comfort of the user.

At last, according to the present invention, the eardrum head is directly used to warp the receiver to perform a function of protection, the eardrum head and the housing are connected and fixed together in a detachable manner, the eardrum head can be easily detached from the housing such that the receiver can be exposed in the air again, and the user can conveniently use alcohol and other disinfectants and tools to clean the cerumen and oily residuals accumulated at the sound outlet position of the receiver. This is conductive for the user to use the hearing aid normally, the use is more hygienic, and after-sales pressure and expenditure are reduced.

The present invention will be further described in detail with reference to the accompanying drawings and the specific embodiments.

Figure 1:
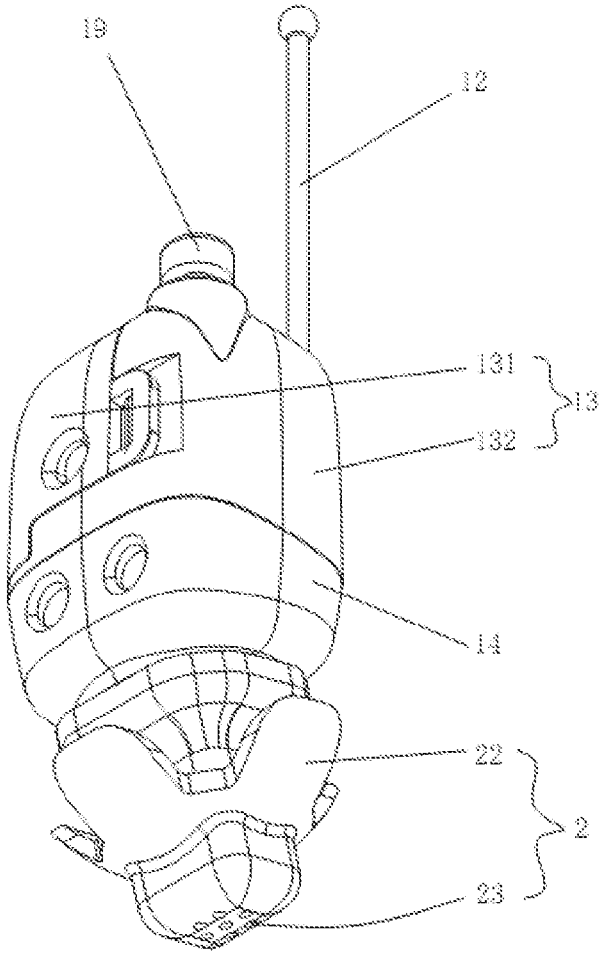
FIG. 1 is a perspective bottom view of the present invention.

EXPLANATION FOR REFERENCE NUMERALS housing 1, sound pick-up hole 11, pulling wire 12, upper housing 13, left half housing 131, right half housing 132, groove 133, clamping strip 134, hook 135, buckle 136, lower housing 14, mounting opening 15, barb 16, groove 17, flange 171, charging hole 18, switch key 19;
eardrum head 2, snap ring 21, fin 22, sound outlet hole 23, filter net 24;
receiver 3, sound outlet 31;
chip 4;
microphone 5; and
battery box 6.

DETAILED DESCRIPTION OF THE EXEMPLARY EMBODIMENTS

Figure 2:
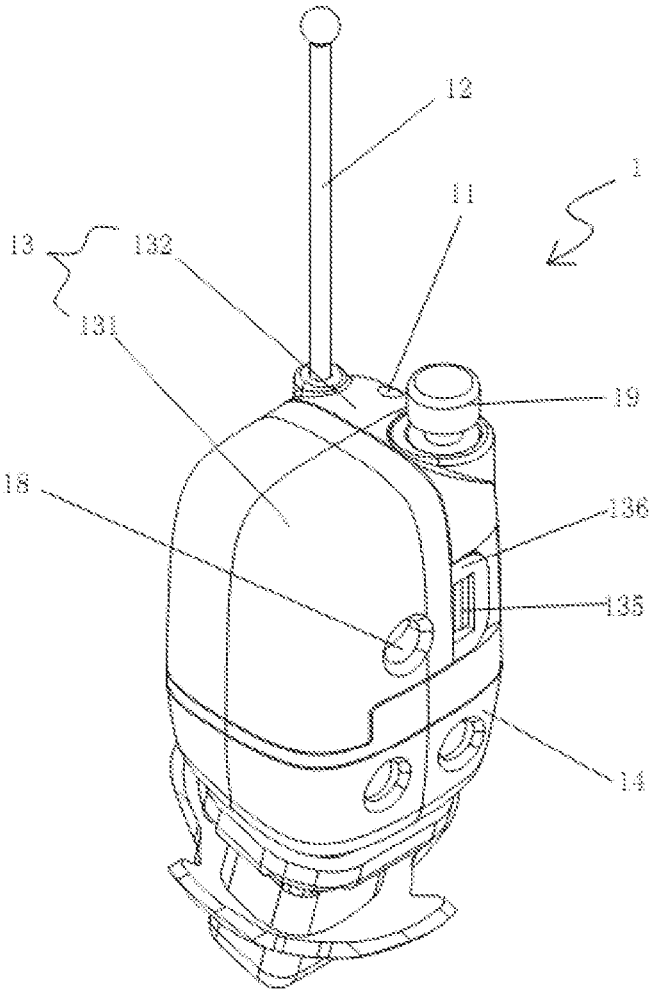
FIG. 2 is a perspective top view of the present invention.
Figure 3:
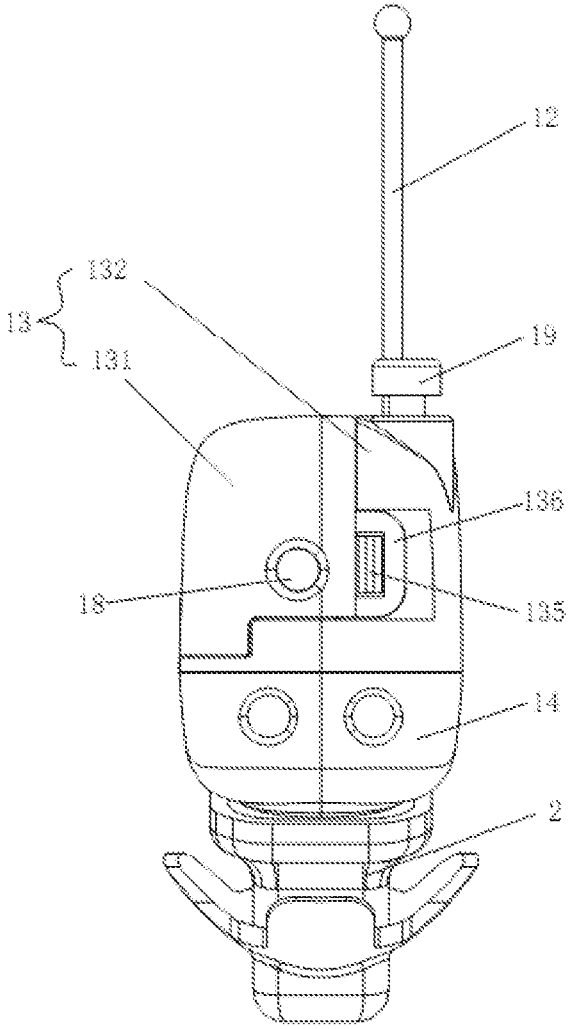
FIG. 3 is a front view of the present invention.
Figure 4:
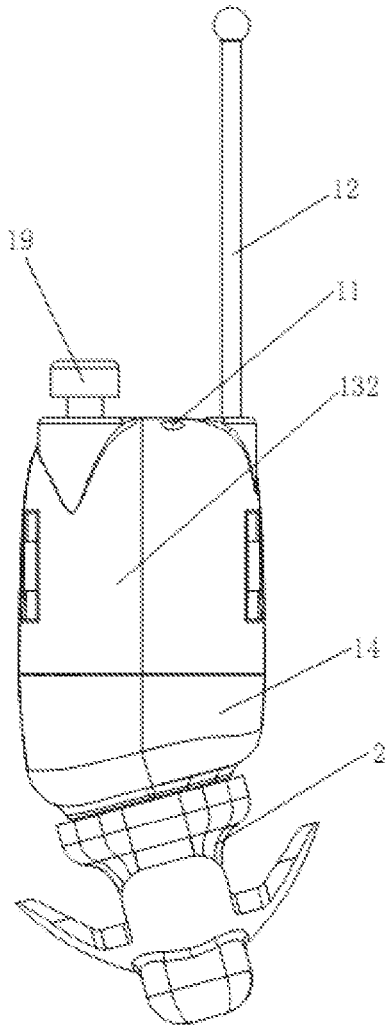
FIG. 4 is a right view of the present invention.
Figure 5:
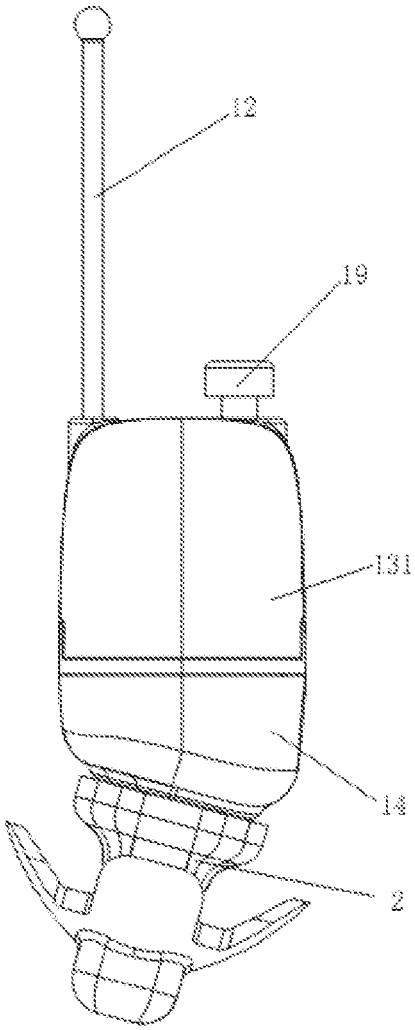
FIG. 5 is a left view of the present invention.
Figure 6:
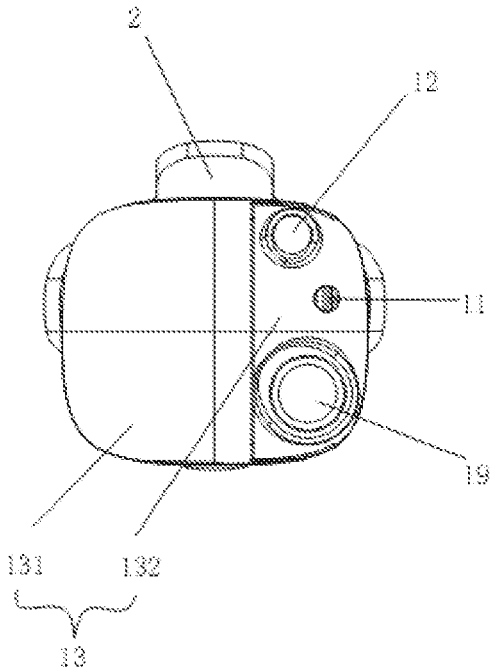
FIG. 6 is a top view of the present invention.
Figure 7:
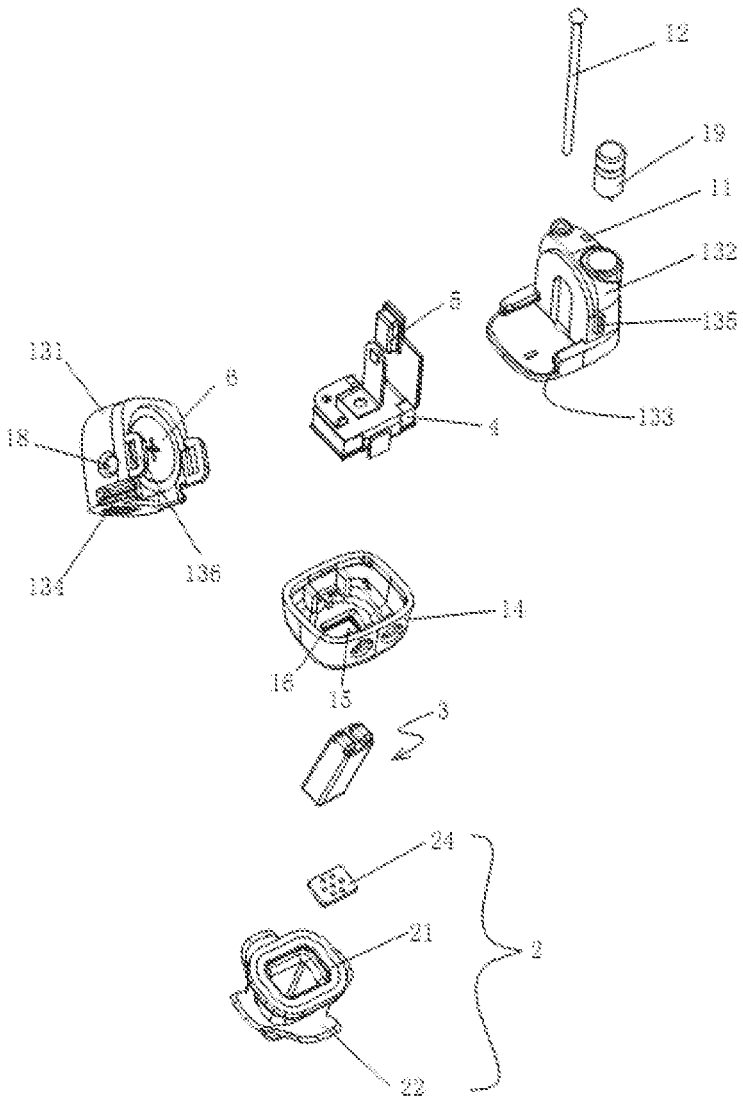
FIG. 7 is a perspective exploded diagram of the present invention.
Figure 8:
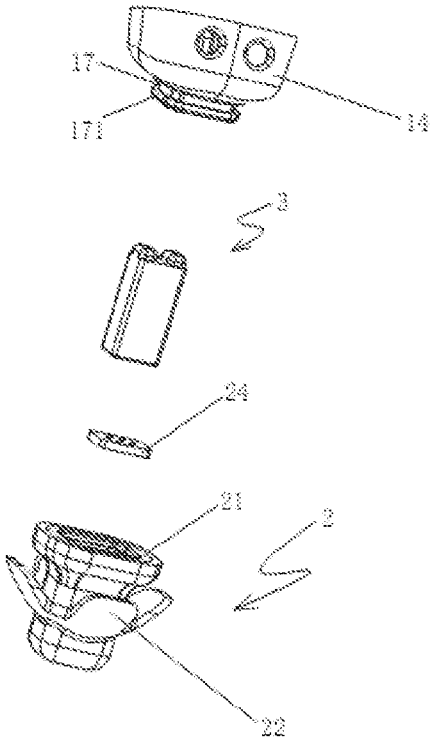
FIG. 8 is a perspective exploded diagram of a receiver, a lower housing and an eardrum head.
Figure 9:
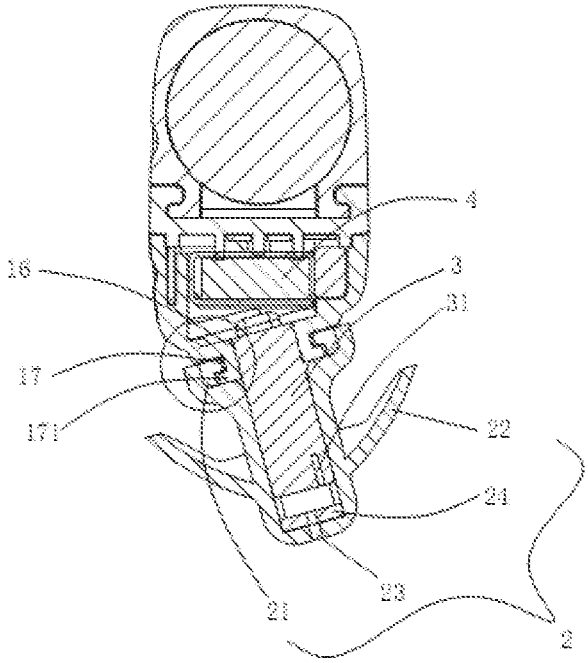
FIG. 9 is a combined cross-section view of the present invention.
Figure 10:
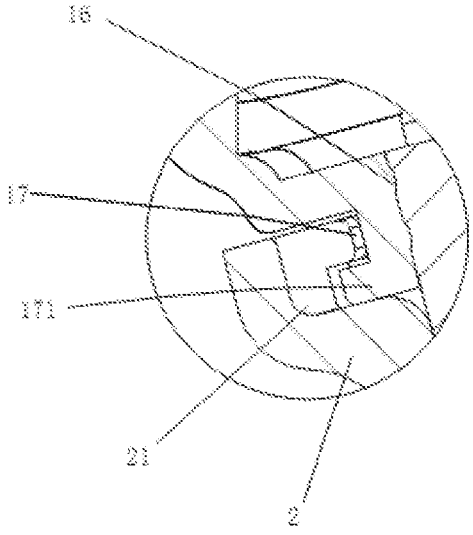
FIG. 10 is a locally enlarged view of the present invention.

As shown in FIG. 1 to FIG. 10, in a miniature ear canal hearing aid disclosed by the present invention, electronic elements other than the receiver 3 are wrapped inside the housing 1, a front end of the housing 1 is sealed and fixed at a rear end of the receiver 3, the sound outlet 31 of the receiver 3 is exposed to an outside of the housing 1, the receiver 3 is wrapped with the eardrum head 2 thereon, the eardrum head 2 can be fixed at the front end of the housing 1 in a detachable manner, and the sound outlet 31 of the receiver 3 is located inside the eardrum head 2. According to the present invention, the housing 1 can use a hard plastic material, and the eardrum head 2 can use a soft rubber material, thereby forming a miniature ear canal hearing aid with a combination of soft and hard housings.

A key point of the present invention is that most portion of the receiver 3 is exposed to the outside of the housing 1, other electronic components (such as the chip 4, the microphone 5 and the like) are still protected inside the hard plastic housing 1, most portion of the housing 1 is used for assembling the other electronic elements and only a very small portion is used for fixing the receiver 3, thus, lengths of both ends of the housing 1 at the bending portion change greatly compared with the traditional technology, one end of the housing 1 at the bending portion only needs to fix the receiver 3, a portion of the housing 1 for fixing the receiver 3 is greatly shortened, the mold of the housing 1 easily processes, and the mold can easily realize a requirement for large-angle bending at a portion for fixing the receiver 3 to thereby implement the large-angle bending of the hearing aid, so as to make the hearing aid conform more to the structure of the human ear canal, which can improve a proportion of the people to whom it adapts and the wearing comfort. In addition, according to the present invention, the soft rubber eardrum head 2 is directly used to wrap the receiver 3 for protection, the area covered by the hard plastic housing 1 is greatly reduced (the volume of the hard plastic housing 1 is reduced) such that the volume of the portion going deep into the ear canal (the volume of the front end of the hearing aid) is significantly reduced, the outer surface of the portion going deep into the ear canal except the inside receiver 3 is basically the soft rubber eardrum head 2, and the hearing aid can easily go deep into the ear canal. This improves the proportion of the people to whom it adapts, enhances the wearing comfort, and has good concealment. Moreover, according to the present invention, the microphone 5 and other electronic elements are wrapped inside the housing 1, and the most portion of the receiver 3 is exposed to the outside of the housing 1 such that the microphone 5 and the receiver 3 (the sound outlet 31) are respectively disposed at the inside and the outside of the housing 1, the connection sealability of the receiver 3 and the housing 1 are good to thereby reduce the risks of the sound leakage and the solid conduction inside the housing 1, the microphone 5 and the receiver 3 do not generate the sound feedback howling due to the inside sound leakage and conduction, and the sound of the receiver 3 is transmitted out via the soft rubber eardrum head 2, which can further avoid the howling due to the vibration of large magnitude generated while being transmitted via the traditional hard plastic housing 1 to thereby improve the production yield and the wearing comfort of the user. In addition, according to the present invention, the eardrum head 2 is used to wrap the receiver 3 in a detachable manner to perform a function of protection, and the user can easily detach the eardrum head 2 according to the needs such that the receiver 3 can be exposed in the air again, so that it is convenient to use alcohol and other disinfectants and tools to clean the cerumen and oily residuals accumulated at the sound outlet 31 position of the receiver 3. This is conductive for the user to use the hearing aid normally, the use is more hygienic, and the after-sales pressure and expenditure are reduced.

According to the present invention, the sealing and fixing structure of the housing 1 and the receiver 3 can be as illustrated in the figures, but is not limited to the structure illustrated in the figures. The front end of the housing 1 forms the mounting opening 15, and the rear end of the receiver 3 is fixed in the mounting opening 15 through fasten fitting. In order to make the fastening more firmly to avoid loose, a sealant can be further disposed between the rear end of the receiver 3 and the mounting opening 15 of the housing 1. Or, barbs 16 are further formed on an inner wall of the mounting opening 15 of the housing 1, and the rear end of the receiver 3 is tightly fixed in the mounting opening 15 by squeezing the barbs 16 to make the barbs 16 deform.

In order to further facilitate the processing and molding of the housing 1, the optimized design of the present invention is: the hearing aid is designed to be in a bending form corresponding to a curvature of the turn of a human ear canal, and the fixing positions of the front end of the housing 1 and the rear end of the receiver 3 are directly located at the bending portion of the hearing aid, so that a bending segment of the housing 1 can be smaller, thus, it is more convenient for processing.

According to the present invention, the detachable fixing structure of the eardrum head 2 and the housing 1 can be illustrated in the figures, but is not limited to the structure illustrated in the figures, the front end of the housing 1 forms the flange 171 and the groove 17, the eardrum head 2 expands outwardly corresponding to the flange 171 and is provided with the snap ring 21 corresponding to the groove 17, and the eardrum 2 is fixed at the front end of the housing 1 with the help of the snap ring 21 being clamped in the groove 17. The snap ring 21 and the main body of the eardrum head 2 can be separately manufactured and then combined together, a material of the snap ring 21 can be different from that of the main body of the eardrum head 2, for example, the main body of the eardrum head 2 is manufactured using silicone to ensure the wearing comfort, and the snap ring 21 is preferably manufactured using a hard plastic material, also, the snap ring 21 and the main body of the eardrum head can be directly molded together using the soft rubber to have a certain elasticity for convenient assembling and fixing.

The fins 22 inclined outwardly from the front to the back are formed around the eardrum head 2 of the present invention to make it more firm after being worn. The eardrum head 2 is opened and provided with sound outlet holes 23, and the filter net 24 is mounted on the sound outlet holes 23. As illustrated in the figures, the sound outlet 31 of the receiver 3 are close to the filter net 24, and the filter net 24 can reduce the pollution of the cerumen and oily residuals.

In addition, according to the present invention, the electronic elements other than the receiver 3 are the chip 4, the microphone 5 and the battery box 6, a battery in the battery box 6 supplies power to the receiver 3, the chip 4 and the microphone 5. External sound is received by the microphone 5, processed by the chip 4, then transmitted to the receiver 3 and played by the receiver 3. The position of the housing 1 corresponding to the microphone 5 is provided with the sound pick-up hole 11, and the external sound enters the housing 1 from the sound pick-up hole 11. The rear end of the housing 1 is further mounted with the pulling wire 12, and the user can conveniently take the hearing aid out from the ear canal by pulling the pulling wire 12. The housing 1 is further provided with the charging hole 18 for charging the battery, and the housing 1 is further provided with the switch key 19 connected with the chip 4 and the battery to control On and Off of the hearing aid and the switching of working modes.

In order to facilitate the processing and manufacturing and operations of assembling and replacing the battery and the like, the optimized structure of the present invention is as illustrated in the figures, but is not limited to the structure illustrated in the figures. The housing 1 is divided into two portions of the upper housing 13 and the lower housing 14, the upper housing 13 is divided into the left half housing 131 and the right half housing 132, a bottom of the right half housing 132 and a top of the lower housing 14 are sealed and joined together, the battery box 6 is mounted in the left half housing 131, and the right half housing 132 and the left half housing 131 are sealed and joined together in a detachable manner so as to facilitate replacement of the battery box 6 and the maintenance of the inside of the hearing aid etc. As for the detachable combination manner of the left half housing 131 and the right half housing 132, it can be as illustrated in the figures but is not limited to the structure illustrated in the figures. The vertical limit fitting groove 133 and clamping strip 134 and the left-right limit fitting hook 135 and buckle 136 are formed between the left half housing 131 and the right half housing 132, thus, the left half housing 131 and the right half housing 132 are buckled together in a vertical direction with the help of the vertical limit fitting of the groove 133 and the clamping strip 134, and the left half housing 131 and the right half housing 132 are buckled and positioned with the help of the left-right limit fitting of the hook 135 and the buckle 136. Thus, the left half housing 131 and the right half housing 132 are firmly joined together.

The above-described are merely the specific embodiments of the present invention, but not used to limit the scope for protection of the present invention. All the equivalent changes made according to the design ideas of the present application fall within the scope for protection of the present application.

What is claimed is:

1. A miniature ear canal hearing aid, comprising: electronic elements other than a receiver being wrapped inside a housing, a front end of the housing being sealed and fixed at a rear end of the receiver, a sound outlet of the receiver being exposed to an outside of the housing, the receiver being wrapped with an eardrum head thereon, the eardrum head being made of a soft rubber material, the eardrum head being fixed at the front end of the housing in a detachable manner, and the sound outlet of the receiver being located inside the eardrum head.

2. The miniature ear canal hearing aid of claim 1, wherein the front end of the housing forms a mounting opening, and a rear end of the receiver is fixed in the mounting opening through fasten fitting.

3. The miniature ear canal hearing aid of claim 2, wherein a sealant is further disposed between the rear end of the receiver and the mounting opening of the housing; or, barbs are formed on an inner wall of the mounting opening of the housing, and the rear end of the receiver is tightly fixed in the mounting opening by squeezing the barbs.

4. The miniature ear canal hearing aid of claim 1, wherein the hearing aid is designed to be in a bending form corresponding to a curvature of a turn of a human ear canal, fixing positions of the front end of the housing and the rear end of the receiver are located at a bending portion of the hearing aid.

5. The miniature ear canal hearing aid of claim 1, wherein the front end of the housing forms a flange and a groove, the eardrum head expands outwardly corresponding to the flange, is provided with a snap ring corresponding to the groove, and is fixed at the front end of the housing with the help of the snap ring being clamped in the groove.

6. The miniature ear canal hearing aid of claim 5, wherein the snap ring and a main body of the eardrum head are separately manufactured and then combined together, or the snap ring and the main body of the eardrum head both are molded using a soft rubber.

7. The miniature ear canal hearing aid of claim 1, wherein the eardrum head is opened and provided with sound outlet holes, and a filter net is mounted on the sound outlet holes.

8. The miniature ear canal hearing aid of claim 1, wherein the electronic elements other than the receiver are a chip, a microphone and a battery box, a battery in the battery box supplies power to the receiver, the chip and the microphone, external sound is received by the microphone, processed by the chip, then transmitted to the receiver and played by the receiver, a position of the housing corresponding to the microphone is provided with a sound pick-up hole, a position of the housing corresponding to the battery box is provided with a charging hole, a switch key is mounted on the housing, and the rear end of the housing is mounted with a pulling wire.

9. The miniature ear canal hearing aid of claim 1, wherein the housing is divided into two portions of an upper housing and a lower housing, the upper housing is divided into a left half housing and a right half housing, a bottom of the right half housing and a top of the lower housing are sealed and joined together, and the battery box is mounted in the left half housing, and the right half housing and the left half housing are sealed and joined together in a detachable manner.

10. The miniature ear canal hearing aid of claim 9, wherein vertical limit fitting groove and clamping strip and left-right limit fitting hook and buckle are formed between the left half housing and the right half housing, and the left half housing and the right half housing are joined together with the help of the vertical limit fitting of the groove and the clamping strip, and the left-right limit fitting of the hook and the buckle.

* * * * *